US011920221B2

(12) United States Patent
Kudo et al.

(10) Patent No.: US 11,920,221 B2
(45) Date of Patent: Mar. 5, 2024

(54) ALUMINUM ALLOY SHEET

(71) Applicant: UACJ Corporation, Tokyo (JP)

(72) Inventors: Tomoyuki Kudo, Tokyo (JP); Ryohei Kobayashi, Tokyo (JP)

(73) Assignee: UACJ Corporation, Tokyo (JP)

( * ) Notice: Subject to any disclaimer, the term of this patent is extended or adjusted under 35 U.S.C. 154(b) by 512 days.

(21) Appl. No.: 17/270,488

(22) PCT Filed: Aug. 28, 2019

(86) PCT No.: PCT/JP2019/033807
§ 371 (c)(1),
(2) Date: Feb. 23, 2021

(87) PCT Pub. No.: WO2020/045537
PCT Pub. Date: Mar. 5, 2020

(65) Prior Publication Data

US 2021/0324501 A1 Oct. 21, 2021

(30) Foreign Application Priority Data

Aug. 31, 2018 (JP) ..... 2018-163486

(51) Int. Cl.
*C22C 21/08* (2006.01)

(52) U.S. Cl.
CPC ..... *C22C 21/08* (2013.01)

(58) Field of Classification Search
CPC ..... C22C 21/06; C22C 21/08; C22F 1/04
See application file for complete search history.

(56) References Cited

U.S. PATENT DOCUMENTS

| | | | |
|---|---|---|---|
| 2008/0302454 | A1 | 12/2008 | Kajihara et al. |
| 2011/0017370 | A1 | 1/2011 | Takaki et al. |

FOREIGN PATENT DOCUMENTS

| | | | |
|---|---|---|---|
| CN | 101268207 | A | 9/2008 |
| CN | 101960031 | A | 1/2011 |
| JP | 2004-244701 | A | 9/2004 |
| JP | 2007-126706 | A | 5/2007 |
| JP | 2009242831 | A | 10/2009 |
| JP | 2009-263781 | A | 11/2009 |
| JP | 4460406 | B2 | 5/2010 |
| JP | 2016-141886 | A | 8/2016 |
| KR | 20150013925 | A | 2/2015 |
| WO | 2007/052416 | A | 5/2007 |

OTHER PUBLICATIONS

Japanese Office Action corresponding to Japanese Application No. 2020-539566 dated Mar. 8, 2022 with English machine translation.
Korean Office Action corresponding to Korean Application No. 10-2021-7006653 dated Dec. 20, 2022 with English machine translation.
International Search Report for the corresponding application No. PCT/JP2019/033807, dated Dec. 3, 2019 with an English translation.
Tsuyoshi Kajiyama, et al., "Aluminum-Manganese and Aluminum-Manganese-Magnesium alloys", vol. 38, No. 6 (1988), pp. 362-373 & its English translation.
Hirofumi Inoue, et al., "Determination of Orientation Distribution Functions from Incomplete Pole Figures by Iterative Series Expansion Method", J. Japan Inst. Metals, vol. 58, No. 8 (1994), pp. 892-898 & its English abstract.
Chinese Office Action corresponding to Application No. 201980056573.7 dated Sep. 2, 2021 with English machine translation.
Korean Office Action corresponding to Korean Application No. 10-2021-7006653 dated Jun. 29, 2022 with English machine translation.
International Preliminary Report on Patentability corresponding application No. PCT/JP2019/033807, dated Mar. 11, 2021 with an English translation.

*Primary Examiner* — Jessee R Roe
(74) *Attorney, Agent, or Firm* — Renner, Otto, Boisselle & Sklar, LLP

(57) ABSTRACT

An aluminum alloy sheet has a composition comprising 0.5% or less by mass of Si, 0.7% or less by mass of Fe, 0.3% or less by mass of Cu, 0.4 to 1.5% by mass of Mn, 0.7 to 1.5% by mass of Mg and an balance comprising Al and inevitable impurities. A degree of integration in the Goss orientation is 1.5 or more. A degree of integration in the Cu orientation is 6.2 or less. A tensile strength is 200 to 310 MPa. An areal ratio of an α-Al—Fe—Mn—Si based intermetallic compound with an equivalent circle diameter of 0.5 μm or more is preferably 2.6% or more.

2 Claims, 1 Drawing Sheet

ALUMINUM ALLOY SHEET

CROSS-REFERENCE TO RELATED APPLICATIONS

This application is a national phase of International Application No. PCT/JP2019/033807 filed Aug. 28, 2019, which claims the benefit of Japanese Patent Application No. 2018-163486 filed on Aug. 31, 2018 with the Japan Patent Office, which are hereby incorporated herein by reference.

TECHNICAL FIELD

The present disclosure relates to an aluminum alloy sheet.

BACKGROUND ART

In recent years, a bottle can that is a type of aluminum can is commercially available. The bottle can comprises a body portion and a neck portion. The neck portion is thin compared to the body portion. The bottle can comprises a thread portion near an end of the neck portion. The bottle can is capable of being resealed using the thread portion and a cap.

The bottle can is manufactured as follows. First, a drawing is performed on a circular blank to form a cup. Then a redrawing is performed on the cup using a body maker. Further, an ironing is performed after the redrawing to form a can body.

Subsequently, an opening portion of the can body is trimmed to make height of the can body even. Next, a necking is performed to form the neck portion. Then the thread portion is formed near the end of the neck portion. Finally, a curling is performed on the end of the neck portion.

When a bottle can is manufactured, the necking causes increase in diameter reduction rate. When the diameter reduction rate is increased in the necking, a large compressive stress is applied to a can wall, and a thickness of the wall is increased. When the wall thickness is increased, an asperity is formed on a surface of the can wall and a minute crack is eventually generated. In a curling process, a breakage due to curling occurs with the minute crack as a starting point.

In Patent Documents 1 and 2, technologies for the purpose of improving breakages due to curling are developed. In the technology disclosed in Patent Document 1, diameters of crystal grains are finely controlled. In the technology disclosed in Patent Document 1, a plane anisotropy of Lankford value is defined. In the technology disclosed in Patent Document 2, conditions of a final pass of a finish rolling and a final pass of a cold rolling are adjusted to define earing ratio and strength before/after baking so that both workability and strength of a bottle can be achieved.

PRIOR ART DOCUMENTS

Patent Documents

Patent Document 1: Japanese Examined Patent Application Publication No. 4460406

Patent Document 2: Japanese Unexamined Patent Application Publication No. 2009-242831A

SUMMARY OF THE INVENTION

Problems to be Solved by the Invention

Through a use of technologies disclosed in Patent Documents 1 and 2, it has been difficult to sufficiently suppress breakage due to curling. A high tensile strength is demanded for an aluminum alloy sheet. One aspect of the present disclosure preferably provides an aluminum alloy sheet capable of suppressing breakage due to curling, and having a high tensile strength.

Means for Solving the Problems

One aspect of the present disclosure provides an aluminum alloy sheet having a composition comprising 0.5% or less by mass of Si, 0.7% or less by mass of Fe, 0.3% or less by mass of Cu, 0.4 to 1.5% by mass of Mn, 0.7 to 1.5% by mass of Mg, and a balance comprising Al and inevitable impurities, and having a degree of integration of 1.5 or more in the Goss orientation, a degree of integration of 6.2 or less in the Cu orientation, and a tensile strength of 200 to 310 MPa. The aluminum alloy sheet according to an aspect of the present disclosure can suppress breakage due to curling and has a high tensile strength.

MODE FOR CARRYING OUT THE INVENTION

Figure 1B:
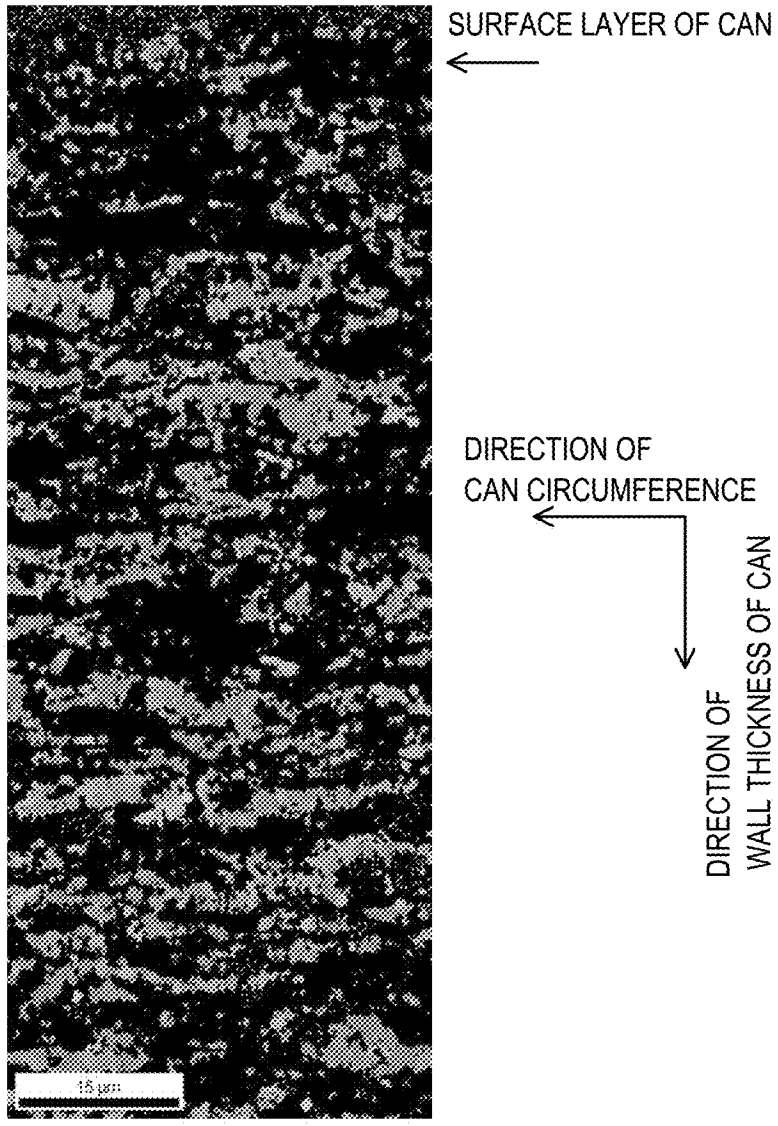
FIG. 1A is an explanatory diagram showing an example of deformation texture A and FIG. 1B is an explanatory diagram showing an example of deformation texture B.

Embodiments of the present disclosure will be described hereinafter with reference to the accompanying drawings.

1. Composition of Aluminum Alloy Sheet

An aluminum alloy sheet according to the present disclosure contains 0.4 to 1.5% by mass of Mn. In the aluminum alloy sheet according to the present disclosure, Mn solid-solutes or precipitates, and thereby contributes to an improvement of strength of the aluminum alloy sheet. Accordingly, Mn improves the tensile strength of the aluminum alloy sheet according to the present disclosure. Because of the Mn content of more than 0.4% by mass, the aluminum alloy sheet according to the present disclosure has a high tensile strength. The Mn content is preferably 0.7% or more by mass. When the Mn content is 0.7% or more by mass, the aluminum alloy sheet according to the present disclosure exhibits a further excellent formability.

There has been a tendency that a giant compound is generated in a conventional aluminum alloy sheet. The giant compound is a large crystallized product having a size of 100 μm or more. The giant compound can be a start point of a breakage during a forming or when an external impact is applied. Because of the Mn content of 1.5% or less by mass, the giant compound is less likely to be generated in the aluminum alloy sheet according to the present disclosure.

Mn forms an Al—Fe—Mn—Si based intermetallic compound. The Al—Fe—Mn—Si based intermetallic compound is in an α-phase. The Al—Fe—Mn—Si based intermetallic compound facilitates an even deformation during a necking forming. The more Mn is contained, the more Al—Fe—Mn—Si based intermetallic compounds there are.

The aluminum alloy sheet according to the present disclosure contains 0.5% or less by mass of Si. The aluminum alloy sheet according to the present disclosure may not contain Si, but the Si content is preferably 0.1% or more by mass. When the Si content is 0.1% or more by mass, the aluminum alloy sheet according to the present disclosure exhibits a further excellent formability.

Because of the Si content of 0.5% or less by mass, precipitations are less likely to be generated during a hot rolling and recrystallization may be facilitated during a hot finish rolling. Consequently, the degree of integration in the Goss orientation tends to be 1.5 or more, and the degree of integration in the Cu orientation tends to be 6.2 or less.

Si together with Mn produces an Al—Fe—Mn—Si based intermetallic compound. The Al—Fe—Mn—Si based intermetallic compound facilitates an even deformation during the necking forming. The more Si is contained, the more Al—Fe—Mn—Si based intermetallic compounds there are.

The aluminum alloy sheet according to the present disclosure contains 0.7% or less by mass of Fe. The Fe content is preferably 0.45% or more by mass. When the Fe content is 0.45% or more by mass, the aluminum alloy sheet according to the present disclosure exhibits a further excellent formability. Because of the Fe content of 0.7% or less by mass, the giant compound is less likely to be generated in the aluminum alloy sheet according to the present disclosure.

Fe together with Si and Mn generates an Al—Fe—Mn—Si based intermetallic compound. The Al—Fe—Mn—Si based intermetallic compound facilitates an even deformation during the necking forming. The more Fe is contained, the more Al—Fe—Mn—Si based intermetallic compounds there are.

According to the present disclosure, the aluminum alloy sheet contains 0.3% or less by mass of Cu. Cu improves the tensile strength of the aluminum alloy sheet according to the present disclosure by forming Al—Mg—Cu based precipitates during a cold rolling or in a coating baking process after canning. The Cu content is preferably 0.05% or more by mass. When the Cu content is 0.05% or more by mass, the aluminum alloy sheet according to the present disclosure exhibits a further excellent tensile strength. Because of the Cu content of 0.3% or less by mass, the tensile strength of the aluminum alloy sheet according to the present disclosure is less likely to be excessively high. Consequently, the aluminum alloy sheet according to the present disclosure is less likely to occur a defect during the forming.

The aluminum alloy sheet according to the present disclosure contains 0.7 to 1.5% by mass of Mg. Mg improves strength of the aluminum alloy sheet according to the present disclosure. Because of the Mg content of 0.7% or more by mass, a sufficient strength of the can body can be ensured for the aluminum alloy sheet according to the present disclosure.

Because of the Mg content of 1.5% or less by mass, the tensile strength of the aluminum alloy sheet according to the present disclosure is less likely to be excessively high. Consequently, breakage during the forming is suppressed from occurring in the aluminum alloy sheet according to the present disclosure.

The aluminum alloy sheet according to the present disclosure may contain 0.1% or less by mass of Ti as inevitable impurities. Ti contributes to refining structure of an ingot.

In the aluminum alloy sheet according to the present disclosure, the balance comprises Al and inevitable impurities. Examples of the inevitable impurities include 0.3% or less by mass of Cr and 0.5% or less by mass of Zn, as well as the above-described Ti. Type and quantity of the inevitable impurities are preferably to the extent to which a performance of the aluminum alloy sheet according to the present disclosure is not significantly impaired.

2. Degree of Integration in the Goss Orientation and Degree of Integration in the Cu Orientation In the aluminum alloy sheet according to the present disclosure, a degree of integration in the Goss orientation is 1.5 or more. The degree of integration in the Goss orientation is a degree of integration in the {110}<100> Goss orientation. In the aluminum alloy sheet according to the present disclosure, a degree of integration in the Cu orientation is 6.2 or less. The degree of integration in the Cu orientation is a degree of integration in the {112}<111> Cu orientation.

The aluminum alloy sheet according to the present disclosure has the degree of integration of 1.5 or more in the Goss orientation and the degree of integration of 6.2 or less in the Cu orientation, whereby breakage due to curling is suppressed. Relationship of the degree of integration in the Goss orientation and the degree of integration in the Cu orientation with unlikeliness of occurrence of breakage due to curling is assumed as below.

When using an aluminum alloy sheet to manufacture a bottle can, a DI forming is performed on a base sheet, followed by a necking forming. The base sheet means an aluminum alloy sheet before the DI forming is performed thereon. The DI forming brings about a deformation of a texture of the base sheet, and a deformation texture (hereinafter to be referred to as a deformation texture of DI can wall) is generated in a can wall. Deforming behavior of the can wall during the necking forming is dominated by the deformation texture of DI can wall.

Evaluations by the inventors identified that the deformation textures of DI can wall includes: deformation texture A in which {111} plane is perpendicular to the DI direction; and deformation texture B in which {100} plane is perpendicular to the DI direction.

Figure 1A:
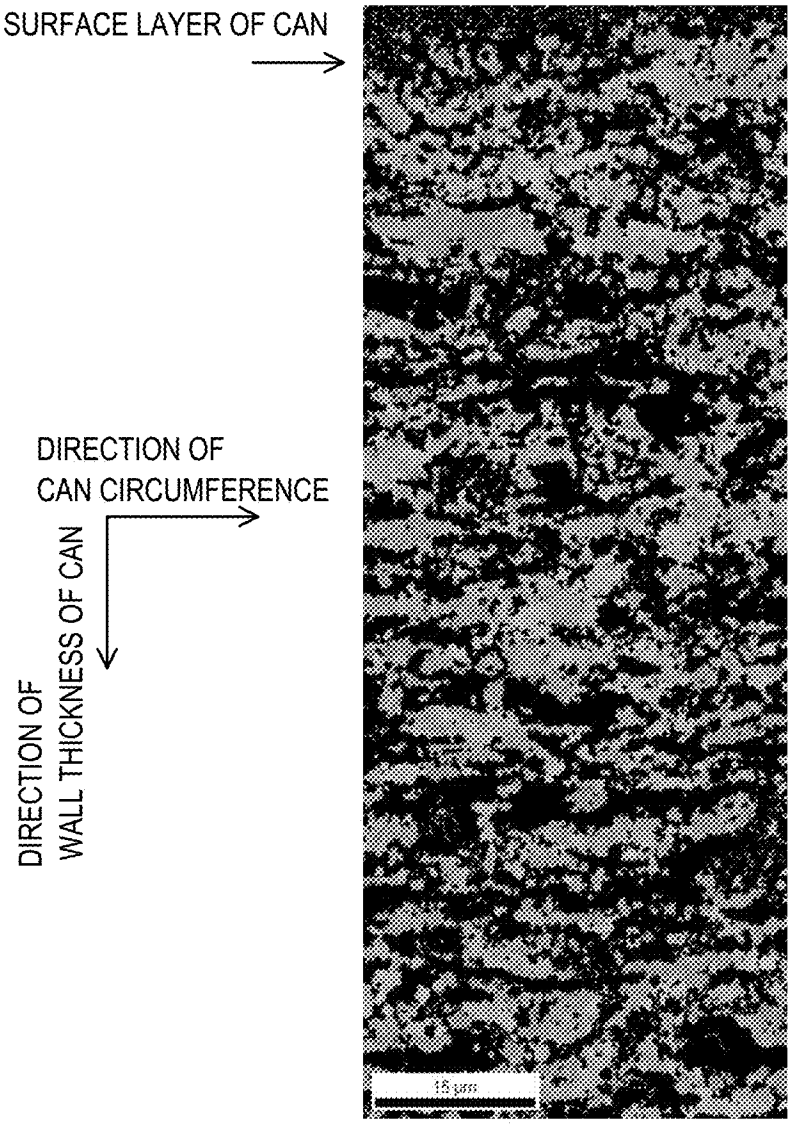

FIG. 1A shows an example of deformation texture A. FIG. 1B shows an example of deformation texture B. FIG. 1A and FIG. 1B are cross-sections of the DI can wall near an opening portion in which each cross-section is perpendicular to the DI direction and observed through SEM-EBSD method, and indicate each distribution of the crystal grains separated by orientation of the crystal grains in the same visual field.

Hereinafter, a crystallite orientation distribution function of the deformation texture of the can wall is expressed following the crystallite orientation distribution function of a texture of a rolled sheet. That is, a surface parallel to a surface of the can wall is regarded as equivalent to a rolled surface. The DI direction (height direction) of the can is regarded as equivalent to a rolling direction. An angle of the crystallite orientation distribution function is expressed in an Euler angle in the Bunge convention. Deformation texture A corresponds to a texture with an angle closer to an angle in the Cu orientation ($\varphi1=90°$, $\Phi=30°$, $\varphi2=45°$). Deformation texture B corresponds to a texture with an angle closer to an angle in the Goss orientation ($\varphi1=0°$, $\Phi=45°$, $\varphi2=0°$).

Deformation texture A deforms along a thickness direction of the can wall during the necking forming and causes an asperity on the surface and forms a minute crack. The degree of integration of deformation texture A correlates with the degree of integration of the base sheet in the Cu orientation. As the degree of integration of the base sheet in the Cu orientation is higher, the degree of integration of deformation texture A of the DI can wall is higher.

Deformation texture B deforms not only along the wall thickness direction but also along the height direction during the necking forming. That is, directions along which deformation texture B deforms during the necking forming are dispersed. Accordingly, deformation texture B only slightly contributes to occurrence of the minute crack on a can wall surface. The degree of integration of deformation texture B correlates with the degree of integration of the base sheet in the Goss orientation. As the degree of integration of the base sheet in the Goss orientation is higher, the degree of integration of deformation texture B of the DI can wall is higher.

Accordingly, by making the base sheet have a lower degree of integration in the Cu orientation and a higher degree of integration in the Goss orientation, a structure capable of suppressing occurrence of the minute crack can be formed on the can wall after the DI forming.

Because of the degree of integration of 1.5 or more in the Goss orientation, directions along which the crystal grains deform during the necking forming are less likely to localize in one direction and the minute crack is less likely to occur on the can wall surface. Consequently, cracks due to curling are less likely to occur. Because of the degree of integration of 6.2 or less in the Cu orientation, deformation along the wall thickness direction during the necking forming is small, and the minute crack is less likely to occur on the can wall surface. Consequently, a breakage due to curling is less likely to occur.

A degree of integration in the Cu orientation and a degree of integration in the Goss orientation can be measured as follows. A square-shaped measurement sample having a length of 2 cm in a rolling direction and a length of 2 cm in a vertical direction is prepared. Using an X-ray diffractometer, the Schultz reflection technique ($\alpha$=15 to 90°, $\beta$=0 to 360°) is applied to surfaces of the measurement sample to obtain incomplete pole figures. The crystallite orientation distribution function f ($\varphi 1$, $\Phi$, $\varphi 2$) is determined from the incomplete pole figures by a series expansion degree of 22 according to the series expansion method. "Standard ODF", which is an analysis software commercially available from Norm Engineering Co., Ltd., is used to determine the crystallite orientation distribution function. A theory for determining the crystallite orientation distribution function from incomplete pole figures is publicly known, as disclosed in, for example, a publication below.

Publication: INOUE Hirofumi, INAKAZU Naotsugu: J. Japan Inst. Metals, Vol. 58 (1994), pp. 892-898.

The crystallite orientation distribution function is analyzed to calculate the degree of integration in the Cu orientation and the degree of integration in the Goss orientation.

3. Tensile Strength

The tensile strength of the aluminum alloy sheet according to the present disclosure is 200 to 310 MPa. The tensile strength of 200 MPa or more improves strength of the formed can body. The tensile strength of 310 MPa or less reduces occurrence of a tear-off (cylinder breakage). The tear-off is a phenomenon that a can body portion is broken during a canning.

Method for measuring the tensile strength is a method regulated in the JIS-Z-2241. As a cold rolling reduction rate for manufacturing the aluminum alloy sheet according to the present disclosure is higher, the tensile strength is higher. As the Mn content in the aluminum alloy sheet according to the present disclosure is more, the tensile strength is higher. As the Cu content in the aluminum alloy sheet according to the present disclosure is more, the tensile strength is higher. As the Mg content in the aluminum alloy sheet according to the present disclosure is more, the tensile strength is higher.

4. Areal Ratio of α-Al—Fe—Mn—Si Based Intermetallic Compound Having Equivalent Circle Diameter of 0.5 μm or More In the aluminum alloy sheet according to the present disclosure, an areal ratio (hereinafter, to be referred to as an areal ratio of the α-phase) of an α-Al—Fe—Mn—Si based intermetallic compound having an equivalent circle diameter of 0.5 μm or more is preferably 2.6% or more.

When the areal ratio of the α-phase is 2.6% or more, the aluminum alloy sheet according to the present disclosure more evenly deforms during the necking forming. Also, when the areal ratio of the α-phase is 2.6% or more, lubricity between the aluminum alloy sheet according to the present disclosure and the mold is improved. Consequently, formability of the aluminum alloy of the present disclosure sheet is improved.

Reasons that the aforementioned effects are exhibited when the areal ratio of the α-phase is 2.6% or more are assumed as below. The α-Al—Fe—Mn—Si based intermetallic compound with an equivalent circle diameter of 0.5 μm or more disturbs movement of the crystal grains during a plastic deformation caused by, such as cold rolling, DI forming and necking forming and suppresses integration in the Cu orientation or deformation of the texture along a particular direction. Accordingly, when the areal ratio of the α-phase is 2.6% or more, the aluminum alloy sheet according to the present disclosure deforms more evenly during the necking forming.

The α-Al—Fe—Mn—Si based intermetallic compound with an equivalent circle diameter of 0.5 μm or more improves lubricity between the aluminum alloy sheet according to the present disclosure and the mold. Consequently, when the areal ratio of the α-phase is 2.6% or more, formability of the aluminum alloy sheet according to the present disclosure is improved.

The areal ratio of the α-phase can be measured according to a method below. Among surfaces of a measurement sample, a surface to be measured is polished. The polishing depth is 1% of a thickness of the measurement sample. The polished surface is observed using a SEM-COMPO and 10 visual fields are obtained. The magnification of the SEM-COMPO is 500×. In respect to each of the 10 visual fields, using an image analysis software "A-zo-kun", an area of a relatively-white particle with an equivalent circle diameter of 0.5 μm or more (hereinafter, to be referred to as a relatively-white area) is calculated. The areal ratio of the α-phase is calculated by dividing the relatively-white area by a total area of the 10 visual fields. Since the α-Al—Fe—Mn—Si based intermetallic compound contains Fe and Mn which are heavier elements than Al, Al being a parent phase of the compound, the compound is observed as a relatively-white particle in a SEM-COMPO image.

5. Method for Manufacturing Aluminum Alloy Sheet According to the Present Disclosure The aluminum alloy sheet according to the present disclosure, for example, may be produced as follows. A semi-continuous casting process (DC casting) is performed on an aluminum alloy with a composition corresponding to the composition of the aluminum alloy sheet according to the present disclosure according to a conventional procedure, to produce an ingot.

Subsequently, surfaces of the ingot are grinded. Then the ingot is put into a soaking furnace and subjected to a homogenizing treatment. The homogenizing treatment is preferably performed at a high temperature. The homogenizing treatment is preferably performed for a long duration. Through the homogenizing treatment, an $Al_6Mn$ intermetallic compound transforms to α-phase.

The temperature at which the homogenizing treatment is performed is preferably 520 to 620° C. The duration for which the homogenizing treatment is performed is preferably 1 to 5 hours. When the homogenizing treatment is performed at a temperature above 520° C., crystallized products sufficiently transform to α-phase. When the homogenizing treatment is performed at a temperature below 620° C., local melting in aluminum alloy is less likely to occur.

When the homogenizing treatment is performed for more than 1 hour, crystallized products sufficiently transform to α-phase. When the homogenizing treatment is performed for 5 hours or more, the homogenizing treatment is no longer effective.

Subsequently, a hot rolling is performed on the ingot on which the homogenizing treatment was performed. The hot rolling comprises a rough rolling and a finish rolling. The rough rolling is a process where the ingot is processed into a sheet material having a thickness of substantially several tens of millimeters through a reverse rolling. The finish rolling is a process where the thickness of the sheet material is reduced to substantially several millimeters through a method such as a tandem rolling and the sheet material is wound up into a coil. The coiled material hereinafter will be referred to as a "hot-rolled coil". The hot-rolled coil is then subjected to a cold rolling. In the cold rolling, the rolling is performed so as to make a sheet thickness as thin as a sheet thickness of a product.

With respect to the final pass in the rough rolling and the final pass in the finish rolling, each Z value expressed by the following Formula (1) can be calculated. When the finish rolling is the tandem rolling, the final pass in the finish rolling is a rolling in the final stand.

[Mathematical Formula 1]

$$Z = \varepsilon \exp\left(\frac{Q}{RT}\right) \quad \text{Formula (1)}$$

In Formula (1), ε is a strain rate. Q is an activation energy of hot working. The value of Q is 156 kJ/mol. R is a gas constant. The value of R is $8.314 JK^{-1} mol^{-1}$. T is a processing temperature. Strain rate ε is calculated from the following Formula (2).

[Mathematical Formula 2]

$$\varepsilon = \frac{2\pi n}{60\sqrt{r}} \sqrt{\frac{R_A}{H_0}} \ln\left(\frac{1}{1-r}\right) \quad \text{Formula}$$

In Formula (2), n is a rotation speed (rpm) of a rolling roll. r is a reduction rate. RA is a radius of a roll. Ho is a plate thickness on inlet side of a rolling mill.

Z value is an index for quantity of strains accumulated during a hot working. As the Z value is greater, recrystallization is more likely to occur. In the hot-rolled coil, a material structure is recrystallized by a residual heat after coiling. Consequently, the degree of integration in the Goss orientation increases. As a rolling structure evolves without occurring the recrystallization in the rough rolling, the degree of integration in the Goss orientation further increases because of the recrystallization occurred after the finish rolling.

Specifically, as the Z value for the final pass in the rough rolling is lower and the Z value for the finish rolling is greater, the degree of integration in the Goss orientation is higher and the degree of integration in the Cu orientation is lower. For example, the Z value for the final pass in the rough rolling may be adjusted so as to satisfy inequality log Z<11.7. In this case, recrystallization during the final pass in the rough rolling can be suppressed. The Z value for the final pass in the rough rolling more preferably satisfies inequality log Z<11.3.

Also, for example, it is preferable to adjust the Z value for the finish rolling to satisfy inequality log Z>14.4 and to set a processing temperature for the finish rolling to 330° C. or more. In this case, the material structure sufficiently recrystallizes. Consequently, the degree of integration in the Goss orientation increases and the degree of integration in the Cu orientation decreases.

The cold rolling may be either a single rolling or a tandem rolling. As the cold rolling ratio is lower, the degree of integration in the Goss orientation is higher and the degree of integration in the Cu orientation is lower. Accordingly, as the cold rolling ratio is lower, breakage due to curling is less likely to occur.

As the cold rolling ratio is higher, the tensile strength of the aluminum alloy sheet according to the present disclosure is higher. When the cold rolling ratio is high, it is preferable to make the degree of integration in the Goss orientation higher and the degree of integration in the Cu orientation lower at the stage of the hot rolling.

The cold rolling ratio is preferably 70 to 85%. When the cold rolling ratio is 70% or more, the tensile strength of the aluminum alloy sheet according to the present disclosure is high. When the cold rolling ratio is 70% or more, a rigidity of the formed can body is high. When the cold rolling ratio is 85% or less, the degree of integration in the Cu orientation is less likely to be excessively high. Consequently, breakage due to curling can be suppressed. The cold rolling ratio is more preferably 83% or less.

As long as a function and effect of the aluminum alloy sheet according to the present disclosure are exhibited, an annealing may be performed, for example, before or after the cold rolling or between the passes in the method for manufacturing the aluminum alloy sheet according to the present disclosure.

6. Embodiment

(6-1) Producing Aluminum Alloy Sheet

Aluminum alloy sheets numbered S1 to S8 in Table 1 were produced. The production method was as follows.

TABLE 1

| | Component (mass %) | | | | | Rough Rolling | Finish Rolling | Cold Rolling Reduction Rate | Degree of Integration | | Areal Ratio of α-phase | Tensile Strength | Curl |
|---|---|---|---|---|---|---|---|---|---|---|---|---|---|
| Sample | Si | Fe | Cu | Mn | Mg | logZ | logZ | (%) | Cu | Goss | (%) | (MPa) | Formability |
| S1 | 0.34 | 0.54 | 0.20 | 1.0 | 1.1 | 11.6 | 14.8 | 84.2 | 6.4 | 2.0 | 2.9 | 301 | X |
| S2 | 0.35 | 0.55 | 0.20 | 1.0 | 1.1 | 11.6 | 14.8 | 82.3 | 6.0 | 2.1 | 2.8 | 295 | ○ |

TABLE 1-continued

| Sample | Component (mass %) Si | Fe | Cu | Mn | Mg | Rough Rolling logZ | Finish Rolling logZ | Cold Rolling Reduction Rate (%) | Degree of Integration Cu | Goss | Areal Ratio of α-phase (%) | Tensile Strength (MPa) | Curl Formability |
|---|---|---|---|---|---|---|---|---|---|---|---|---|---|
| S3 | 0.30 | 0.41 | 0.21 | 1.0 | 1.1 | 11.3 | 14.8 | 83.1 | 6.9 | 2.0 | 2.4 | 301 | X |
| S4 | 0.32 | 0.53 | 0.20 | 1.0 | 1.1 | 11.1 | 14.8 | 83.9 | 6.4 | 2.3 | 2.7 | 295 | X |
| S5 | 0.31 | 0.42 | 0.20 | 1.0 | 1.1 | 11.1 | 14.5 | 84.4 | 6.5 | 2.3 | 2.6 | 307 | X |
| S6 | 0.33 | 0.51 | 0.19 | 1.0 | 1.1 | 11.1 | 14.5 | 84.4 | 6.1 | 2.2 | 2.8 | 297 | ○ |
| S7 | 0.33 | 0.51 | 0.19 | 1.0 | 1.1 | 11.2 | 15.0 | 71.9 | 5.2 | 1.8 | 2.7 | 273 | ○ |
| S8 | 0.33 | 0.51 | 0.19 | 1.0 | 1.1 | 11.2 | 14.9 | 71.9 | 4.9 | 1.8 | 2.6 | 233 | ○ |

First, an ingot was produced through a semi-continuous casting method. A composition of the ingot is shown in Table 1. A thickness of the ingot was 700 mm. The ingot contained 0.03% by mass of inevitable impurity elements. Subsequently, four surfaces of the ingot were ground. Then the ingot was put into a furnace and subjected to a homogenizing treatment under conditions shown in Table 1.

Subsequently, a hot rolling was started immediately after the ingot was ejected from the furnace. A hot rolling machine used then comprises a reversing hot rough rolling machine and a tandem hot finish rolling machine. Z values for a final pass in the reversing hot rough rolling were controlled to values shown in Table 1. Also, Z values for a final stand in the tandem hot finish rolling were controlled to values shown in Table 1.

Then a cold rolling was performed. Cold rolling ratio in the cold rolling was set to each value shown in Table 1 by adjusting a plate thickness after the hot finish rolling.

(6-2) Evaluation of Aluminum Alloy Sheet

Test pieces #5 regulated in the JIS-Z-2241 were made out from the produced aluminum alloy sheet. The test pieces extended along a direction forming an angle of 0° relative to a rolling direction. A tensile test was conducted on the test pieces in accordance with JIS-Z-2241 to measure tensile strength. Measurement results of the tensile strength are shown in Table 1.

The produced aluminum alloy sheet was measured for degree of integration in the Goss orientation and degree of integration in the Cu orientation through the above-described measurement method. For an X-ray diffractometer, RINT-2500V/PC made by Rigaku Corporation was used. Measurement results of the degree of integration in the Goss orientation and the degree of integration in the Cu orientation are shown in Table 1.

The produced aluminum alloy sheet was measured for areal ratio of α-phase through the above-described measurement method. Measurement results of the areal ratio in α-phase are shown in Table 1.

Out of the produced aluminum alloy sheet, can bodies were formed through a DI so that each body had a diameter of 66 mm. Subsequently, each flange of the can bodies was formed into a neck with a diameter of 32 mm, and each end of the neck was formed into a curling. Samples having 10% or less of occurrence rate of breakage due to curling were determined to be good in terms of evaluation result of curl formability. Samples having more than 10% of occurrence rate of breakage due to curling were determined to be poor in terms of evaluation result of curl formability. "Good" was indicated with "○" and "poor" was indicated with "x" in Table 1.

With respect to S2, S6, S7 and S8, each degree of integration in the Cu orientation was below 6.2, and therefore each evaluation result for curl formability was good and each tensile strength was high. On the contrary, with respect to S1, S3, S4 and S5, each degree of integration in the Cu orientation was over 6.2 and therefore each evaluation result for curl formability was poor.

S6 had a better evaluation result for curl formability than S5 or S6. This was because that S6 contained 0.45% or more by mass of Fe, whereby the areal ratio of α-phase was high and the degree of integration in the Cu orientation was low.

With respect to S7 and S8, each cold rolling reduction rate was low and each degree of integration in the Cu orientation was low. This means that the degree of integration in the Cu orientation can be kept low by reducing the cold rolling reduction rate.

S4 had a lower log Z for the rough rolling and a higher degree of integration in the Goss orientation than S 1. This means that the degree of integration in the Goss orientation can be increased by making log Z for the rough rolling low.

7. Other Embodiments

Although some embodiments of the present disclosure have been described above, the present disclosure is not limited to the aforementioned embodiments, but may be implemented in various forms.

(1) A function performed by a single element in the aforementioned embodiments may be achieved by a plurality of elements, or a function performed by a plurality of elements may be achieved by a single element. Also, a part of a configuration in the aforementioned embodiments may be omitted. Further, at least a part of a configuration in one of the aforementioned embodiments may be added to, or may be replaced with, a configuration in another one of the aforementioned embodiments. Any form included in the technical idea defined by the language of the appended claims may be an embodiment of the present disclosure.

(2) The present disclosure can also be implemented in various forms besides a form of the above-described aluminum alloy sheet, such as a system comprising the aluminum alloy sheet, and a production method of the aluminum alloy sheet.

The invention claimed is:

1. An aluminum alloy sheet having a composition comprising:

0.1 to 0.5% by mass of Si;

0.45 to 0.7% by mass of Fe;

0.05 to 0.3% by mass of Cu;

0.4 to 1.5% by mass of Mn;

0.7 to 1.5% by mass of Mg; and an balance comprising Al and inevitable impurities, wherein a degree of integration in the Goss orientation is 1.5 or more, wherein a degree of integration in the Cu orientation is 6.2 or less, and wherein a tensile strength is 200 to 310 MPa.

2. The aluminum alloy sheet according to claim 1, wherein an Mn content is 0.7 to 1.5% by mass, and wherein an areal ratio of an α-Al—Fe—Mn—Si based intermetallic compound with an equivalent circle diameter of 0.5 μm or more is 2.6% or more.

* * * * *